United States Patent [19]

Walter

[11] 4,402,457

[45] Sep. 6, 1983

[54] FUEL INJECTOR WITH ABRUPT AND STABLE TERMINATION

[75] Inventor: Richard P. Walter, Southfield, Mich.

[73] Assignee: The Bendix Corporation, Southfield, Mich.

[21] Appl. No.: 288,729

[22] Filed: Jul. 31, 1981

[51] Int. Cl.[3] ..... F02M 47/02

[52] U.S. Cl. ..... 239/91; 239/92

[58] Field of Search ..... 239/92, 88, 93, 94, 239/95

[56] References Cited

U.S. PATENT DOCUMENTS

| | | | |
|---|---|---|---|
| 2,279,010 | 4/1942 | Nichols | 239/92 X |
| 2,793,077 | 5/1957 | Bovard | 239/92 |
| 3,083,912 | 4/1963 | Shallenberg | 239/92 X |

*Primary Examiner*—John J. Love

*Assistant Examiner*—Mary McCarthy

*Attorney, Agent, or Firm*—Markell Seitzman; Russel C. Wells

[57] ABSTRACT

A diesel fuel injector having two separate annular or annulus-to-annulus dumps for providing a variable and a fixed orifice rapidly and controllably terminating injection and for controlling the impact velocity of the injector's intensifier piston against a mating stop. The injector further includes a middle chamber that is always connected to a low pressure vent to permit the collection and diversion of leakage fuel away from the middle chamber. The intensifier piston includes an upper member that is received within a stepped bore. The intensifier piston is loosely received within a lower member to permit relative motion therebetween for preventing the gall-up of the intensifier piston against the walls of the cooperating stepped bore.

7 Claims, 10 Drawing Figures

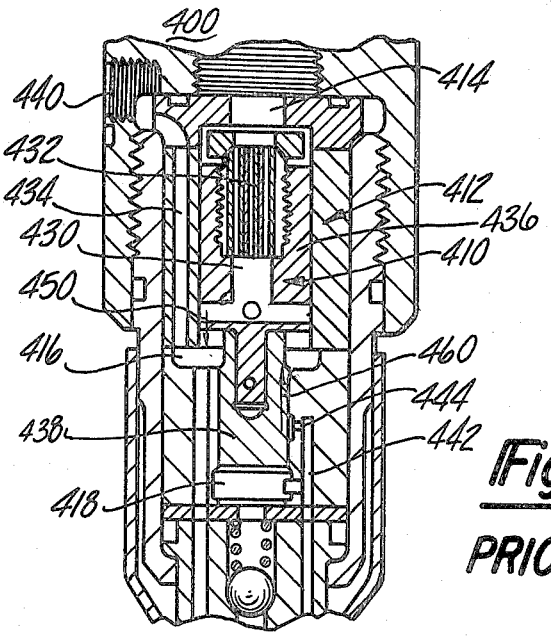
Fig-9
PRIOR ART
Fig-10
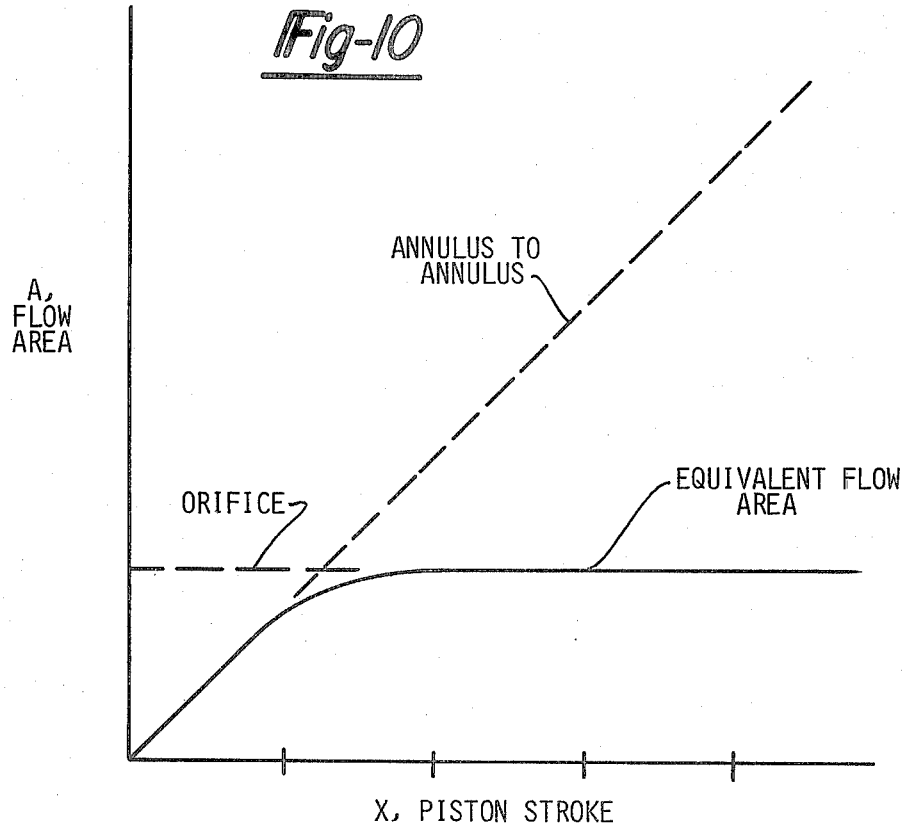

FUEL INJECTOR WITH ABRUPT AND STABLE TERMINATION

BACKGROUND AND SUMMARY OF THE INVENTION

This invention relates to fuel injectors for diesel engines.

FIG. 9 is illustrative of prior art diesel fuel injectors incorporating therein an intensifier piston 410. The intensifier piston 410 cooperates with the adjacent parts of the housing 412 to create an upper chamber 414, a middle chamber 416, and a metering chamber 418. The intensifier piston further includes an internal passage 430 having inserted therein a capillary or laminar flow restrictor 432. The intensifier system 40 may be fabricated of unitary construction or equivalently may include an upper member 436 that is pressfit into a lower number 438 to define a stepped outer contour of the intensifier piston. The intensifier piston is movably received within a stepped bore 439 provided by the housing 412. The excess fuel that is received within the upper chamber 414 is dumped in correspondence with motion of the intensifier piston 410 through the passage 430 through the middle chamber 416 and passage 434 to a port 440.

Prior to injecting fuel from the injector 400, a predetermined quantity of fuel is received into the metering chamber 418 in a known manner. After injection, that is after the intensifier piston 410 has compressed and injected the fuel within the metering chamber 418 to a determinably high pressure level, this high pressure fuel is dumped through passages 442, 444 into the middle chamber 416 and through the cooperating passage 434 to the port 440.

To increase the efficiency of the operation of the fuel injector 400 it is desirable to prohibit fuel from leaking into the middle chamber. It can be seen that if a sufficient quantity of fuel resides within the middle chamber 416 additional work must be expended to compress this fuel, thus reducing the efficiency of operation of the intensifier piston. During normal operation, the intensifier piston 410 is caused to move downward within the stepped bore 439 by introducing into the upper chamber 414 a fluid having a high pressure level. It can be seen, however, that this high pressure fuel which is also received within passage 430 has a tendency to leak between the sides of the piston and cooperating housing parts and flow into the middle chamber. This leakage from the passage 430 into the middle chamber is shown by the arrow designated as 450. In addition, as the intensifier piston is moving downward, thus compressing the fuel within the metering chamber 418, the fluid pressure level within the passage 442 increases substantially and consequently another leakage path exists, as designated by the arrow 460, which permits fuel within the metering chamber to similarly leak into the middle chamber 416. If the leakage of fuel into the middle chamber 416 is not controlled, the efficiency of operation of the injector decreases, unnecessary heating is produced and larger injectors are required to compensate for this inherent inefficiency.

Prior art fuel injectors are further characterized by premature failure due to gall-up of the intensifier piston. Prior art fuel injectors are fabricated by employing costly and precise machining tolerances to control the concentricity of the bores defining the upper and lower parts of the stepped bore 439, and the cylindricity of the intensifier piston 410. Precise machining tolerances are required to attempt to maintain the intensifier piston in an axial alignment with the stepped bore. If the intensifier piston becomes skewed relative to the stepped bore it will gall-up, become seized, and fail.

It is therefore an object of the present invention to control both the amount and direction of the leakage flow and to minimize the leakage flowing into the middle chamber of an injector. In addition, it is an object of the present invention to control the leakage flow by eliminating fluid passages through the intensifier piston. It is another object of the present invention to improve the efficiency of operation of a diesel fuel injector having an intensifier piston therein and to do so in an uncomplicated manner. A further object of the invention is to provide a fuel injector which does not require exacting machining tolerances and a fuel injector having an intensifier piston that does not tend to gall-up. A feature of the present invention which permits the control of the leakage flow is the incorporation of a piston annulus which is always connected to a low pressure vent therein permitting the collection and diversion of the leakage fuel away from the middle chamber. An additional feature of the present invention is a two member intensifier piston that permits translational movement between its members. This translational degree of freedom permits each member to move freely within a corresponding part of a stepped bore without gall-up.

A further feature of the invention is to provide a diesel fuel injector having dump ports which accomplish the following:

(1) Rapidly terminate injection for good engine performance, but not too rapidly that the injection fuel pressure drops below the combustion pressure before the nozzle needle closes, which would cause blowback of combustion gases.

(2) Limit the nozzle needle closing impact velocity to an acceptable limit for durable performance.

(3) Smoothly dump excess pump flow to prevent excessively high pressure and cavitation.

(4) Decelerate the intensifier piston so that the piston impact velocity after injection is tolerable for durable performance.

(5) Control line dynamics so that the intensifier piston will remain in its reference (bottom) position after injection until the start of the next metering cycle for repeatable, predictable injection quantities.

These requirements are met by having two separate dumps which have either annular or annulus-to-annulus dumps which open extremely fast and, in addition, each dump has an orifice in series to limit the amount of flow therethrough. With the combination of a variable orifice (annulus) and a fixed orifice, the rapid termination of injection is accomplished. The fixed orifice is used to control the impact velocity and to stabilize the injector pressure and intensifier piston. The dump flow area is shown graphically in FIG. 10.

More specifically, the invention comprises a diesel fuel injector having metering and injection modes of operation. The fuel injector comprises a housing having a plurality of fuel carrying passages therein. These fuel carrying passages terminate at a first port that is adapted to receive pressurized fuel from a first fuel source and in a second port which is similarly adapted to receive pressurized fuel from a second fuel source. The housing further includes a stepped bore defining therein an upper bore, a middle bore, and a lower bore situated below the middle bore. The housing further includes a first dump port means located within the upper bore and a second dump port means located within the lower bore. The first dump port means comprising an annulus and an orifice in series. The fuel injector further includes an intensifier piston reciprocatively situated within the stepped bore defining, in cooperation with the housing, a plurality of variable volume chambers such as an upper or primary chamber, an inner or middle chamber, and a lower or metering chamber. The intensifier piston comprises a cylindrical upper member having walls that are fluid tight and reciprocatively received within a mating wall of the upper bore and further includes a first pressure receiving surface defining the lower extremes of the upper chamber. The upper member further includes a bottom defining the upper extreme of the middle chamber. In addition, the length of the upper member is sized so that the first pressure receiving surface will uncover the first dump port means in correspondence with the piston travel. The intensifier piston further includes a lower member, having an outer cylindrical wall, which is operatively connected to the upper member. The lower member further includes a bottom defining a second pressure receiving surface which forms the upper extreme of the lower or metering chamber. As mentioned the lower member further includes the second dump port means that comprises a lower annulus and a second dump orifice combination. The lower annulus is located intermediate the middle and metering chambers. The lower annulus is maintained in constant fluid communication with the second dump orifice which in turn is connected to the second fuel source. The fuel injector further includes first check valve means connecting the metering chamber with the second port for permitting fuel flow into the metering chamber from the second port during the metering mode of operation and for preventing backflow during the injection mode of operation. The diesel fuel injector further includes a pressure activated nozzle means extending from the housing and maintained in fluid communication with the metering chamber for injecting fuel therefrom in correspondence with the pressure within the metering chamber. The housing of the fuel injector further includes a first passage which connects the metering chamber with the first dump port means, a second passage which connects the first dump port means to the second port wherein a second check valve means is situated within the second passage for permitting flow of fuel from the first dump port means to the second port and for preventing reverse flow thereto.

For the present injector to operate properly, it is desirable, therefore, that additional fuel does not enter the middle chamber. Consequently, it is necessary to design the injector to have a minimum number of leakage paths between the higher pressure upper chamber or the metering chamber and the middle chamber. Practically it is unlikely to construct a piston which does not have any leakage paths. Consequently, it is necessary to control the leakage paths to prevent fuel from entering the middle chamber. This is accomplished by providing the previously described low level pressure secondary dump port means intermediate the middle chamber and the metering chamber. It can be seen that the lower annulus and orifice in series provides two functions. The first is to dump the high pressure fuel within the metering chamber at the end of the injection cycle and secondly, to provide a leakage path for fuel leakage from the metering chamber away from the inner chamber during the injection mode of operation.

BRIEF DESCRIPTION OF THE DRAWINGS

FIG. 9 is a partial sectional diagram of a prior art diesel fuel injector.

FIG. 10 graphically illustrates the dump port flow area as a function of intensifier piston stroke.

DETAILED DESCRIPTION OF THE DRAWINGS

Figure 1:
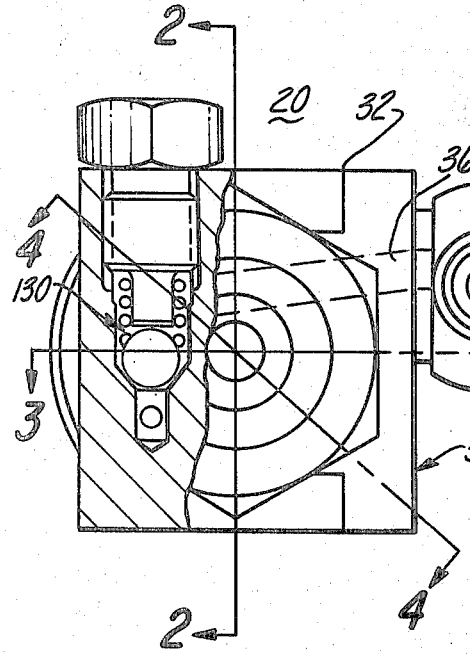
FIG. 1 is a top view of the diesel fuel injector.
Figure 2:
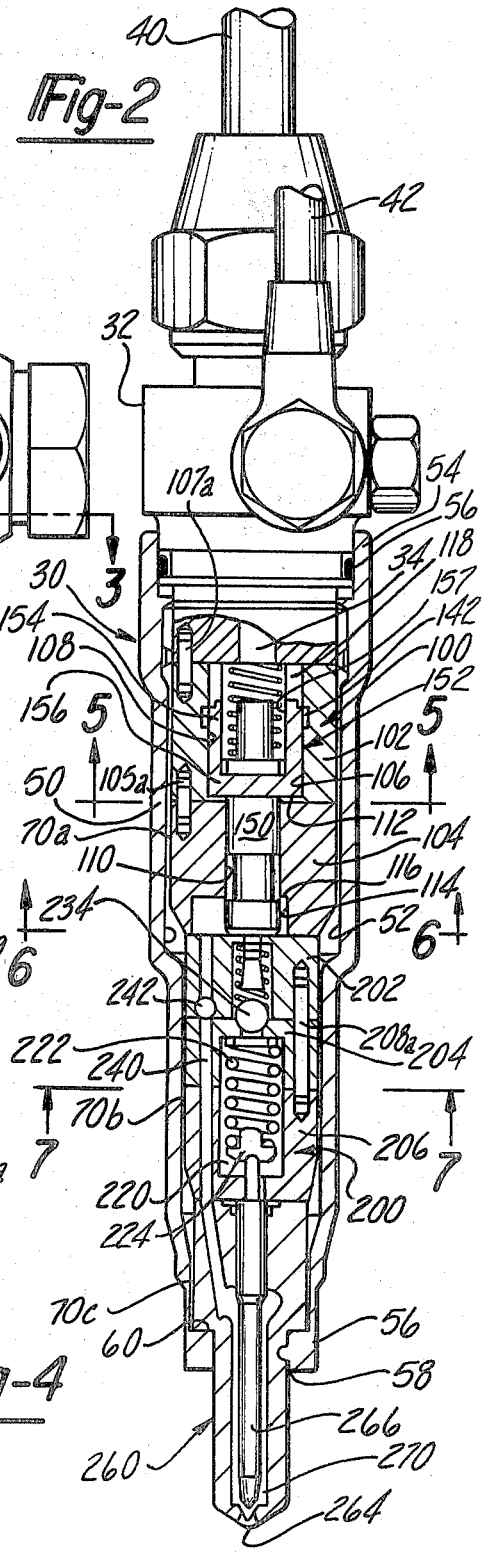
FIG. 2 is a cross-sectional view taken through Section 2—2 of FIG. 1.
Figure 3:
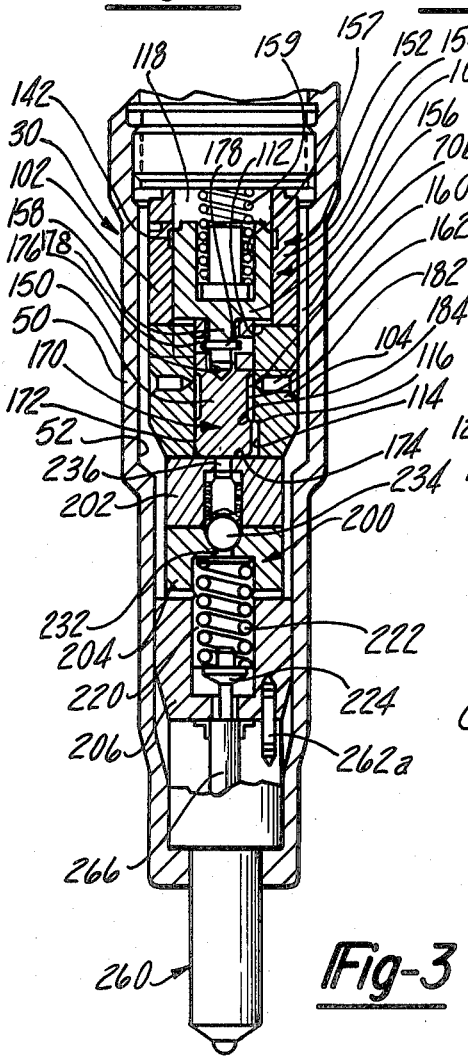
FIG. 3 is a partial sectional view taken through Section 3—3 of FIG. 1.

Reference is now made to FIGS. 1, 2 and 3 which illustrate respectively a top and cross-sectional views of a fuel injector 20. The fuel injector 20 comprises a housing 30 which includes a head 32 having a plurality of fuel passages 34, 36 located therein. The head 32 further includes a first port 40 and a second port 42 that are each respectively adapted to communicate with a first and a second source of fuel (not shown). More specifically, it is envisioned that the first port 40 will be connected to a pump and the second port 42 would be connected to another pump or to an accumulator in a manner as illustrated by Walter et al in the commonly assigned patent application, U.S. Ser. No. 217,297 filed Dec. 17, 1980 which is herein incorporated by reference. The pump, accumulator and injector 20 is shown schematically in FIG. 8. Referring again to FIGS. 1, 2 and 3, the housing 30 further includes a hollow jacket 50 having a stepped bore 52 therein. The upper end 54 of the jacket 50 is adapted to engage a mating section of the injector head 32. As illustrated in accompanying diagrams, the head is threadably received within the upper end 54 and utilizes an O-ring seal 56 to provide a fluid type seal therebetween. The jacket 50 further includes a lower end 56 which terminates in a centrally located opening 58 forming a shoulder 60.

The injector 20 may include a plurality of assemblies such as a piston retainer 100, a spring cage 200 and a nozzle 260 which are inserted within the hollow jacket 50, stacked and pinned one to the other in an aligned engagement. In addition, each of these assemblies are loosely received within the stepped bore 52 of the hollow jacket 50 such that the flow passages 70*a, b,* and *c* are created between the sides of these assemblies and the interior of the stepped bore 52. As discussed below, the passages 70 are maintained in fluid communication with port 42.

The piston retainer 100 comprises two cylindrical members 102 and 104 which together define a second stepped bore 106. The members 102 and 104 are joined by pins 105*a* and *b;* however, only pin 105*a* is visible in FIG. 2. The member 102 is joined to the lower end of the head 32 by a plurality of pins 107*a* and *b;* however, only pin 107*a* is shown in FIG. 2. The stepped bore 106 comprises the upper bore 108 which terminates in a narrower second bore 110; the transition surface therebetween forms a shoulder 112. The stepped bore 106 further includes a lower third bore 114. The transition surface between the third bore 114 and the second bore 110 defines a second transition surface or shoulder 116.

The intensifier piston 150 and piston retainer 100 cooperate to define a plurality of variable volume chambers such as an upper or primary chamber 118, a middle or inner chamber 120 and a lower or metering chamber 122. These chambers are more clearly shown in FIG. 4.

Figure 4:
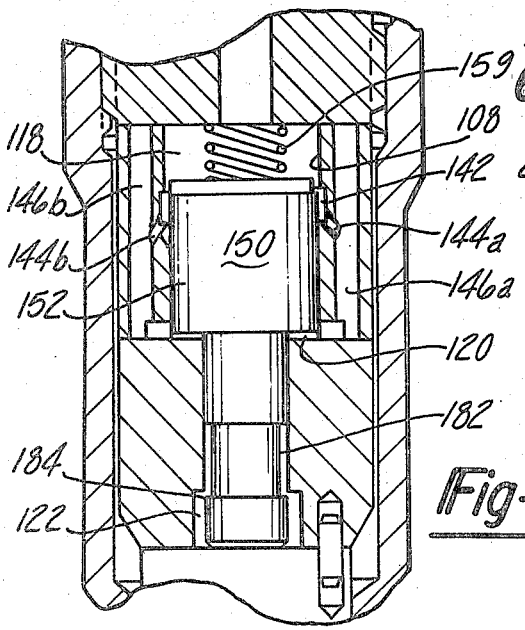
FIG. 4 is a partial sectional view illustrating the intensifier piston of the present invention taken through Section 4—4 of FIG. 1.

The piston retainer 100 further defines a first dump port means, which as described below, cooperates to selectively dump the fluid received at the first port 40 through to the second port 42 in correspondence with the motion of an intensifier piston 150. In addition the piston retainer 100 and intensifier further cooperate to define a second dump port means that controllably dumps the fluid within the metering chamber 122 to the second port 42 and provides a preferred leakage path to prevent unwanted fuel from accummulating in the metering chamber. FIG. 4 illustrates a partial cross-sectional view of the injector 20 taken through Section 4—4 of FIG. 1 and illustrates in greater detail the first dump port means. More specifically, the first dump port means comprises a first or annular dump port 142, and the orifices 144. The dump port 142, in the preferred embodiment, comprises an annular recess fabricated within the walls of the upper bore 108. The annular dump port 142 is connected to a plurality of fluid passages or orifices 144*a* and *b*. FIG. 4 illustrates the two fluid passages or orifices 144. The two orifices 144*a* and *b* are connected to a corresponding one of four fluid passages 146*a–d*. The lower extreme of each fluid passage 146 is connected to the inner or middle chamber 120, while the upper portions of each of the fluid passages are connected via fluid passages within the head 32 to a check valve 130. The output of the check valve in turn is connected via fluid passage 36 to the second port 42. The check valve 130 is connected such that fluid can flow from the fluid passages 146 through to the second port 42 while flow from the second port 42 into the passages 146 is inhibited. The check valve 130 is illustrated in the top view of the injector shown in FIG. 1 and in the schematic diagram of FIG. 8. It should be appreciated that FIG. 4 illustrates the piston 150 at the bottom of its stroke. The piston 150 will attain this position at the end of the injection mode of operation. In this position the piston 150 uncovers a portion of the annular dump port 142. This positioning creates a flow path to port or dump the fuel within the upper or primary chamber 118, which is at a high pressure level at the end of an injection cycle, through the orifices 144 to the second port 42, thus controllably relieving the pressure within the primary chamber 118. It should be recalled that the second port 42 is connected to the second fuel source which is maintained at a pressure level less than the pressure created within the primary chamber during an injection cycle. It can therefore be seen that by dumping fuel through the first dump port means as described above, excess pump flow is controllably dumped to prevent creating excessively high or low pressures within the upper chamber. In addition, by shaping the area of the first dump port means, in the manner as shown in FIG. 10, the deceleration of the intensifier piston is shaped and its impact velocity against its stop, which is provided by the spring retainer section 202, is controlled to enhance durability. The upstream line dynamics are controlled to prevent line cavitation. All of this ensures that the intensifier piston is not moved from its bottommost position which is the reference position for the next metering cycle.

Figure 5:
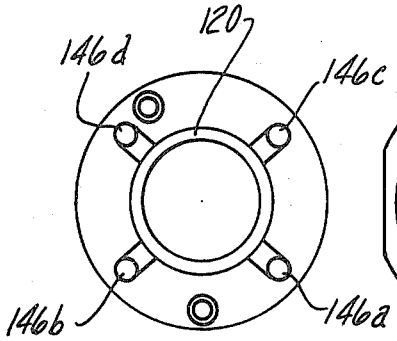
FIG. 5 is a cross-sectional view taken through Section 5—5 of FIG. 2.
Figure 6:
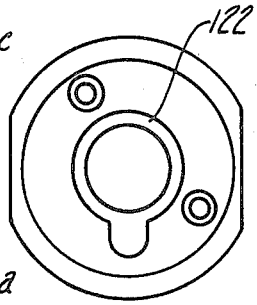
FIG. 6 is another cross-sectional view illustrating the inner chamber of the present invention taken through Section 6—6 of FIG. 2.

Reference is made to FIG. 5 which is a sectional view taken through Section 5—5 of FIG. 2 and illustrates the placement of the four fluid passages 146*a–d* with respect to the middle chamber 120.

Reference is now made to the intensifier piston 150, shown in FIGS. 2, 3 and 4, which is slidably received within the stepped bore 106. The intensifier piston comprises an upper member 152 having a cylindrical wall 154 that terminates at a bottom 156. In the preferred embodiment of the invention, the upper member 152 comprises a cup-like structure having a recessed bore 157 that is sized to receive a biasing spring 159. The spring 159 is positioned between the bottom edge of the head 32 and the bottom 156 of the upper member and serves to lightly bias the piston 150 towards the bottom of its stroke. It is desirable that the piston 150 be referenced in its most downward position for accurate fuel metering control. The upper member 152 further includes a projection 158 (shown in FIG. 3) extending from the bottom 156.

The intensifier piston 150 further includes a lower member 170 having substantially cylindrical walls 172 and a bottom 174. The lower member 170 includes a bore 176 which is sized to loosely receive the projection 158 of the upper member 152. A pin 178 may be used to secure the lower member to the upper member. In the embodiment of the invention illustrated in FIG. 3 the pin 178 is loosely received through a bore 180 fabricated in the walls 172, however, analysis indicates that pin 178 is not a requirement. By providing the intensifier piston 150 with a degree of freedom between its upper and lower members permits each member to be self centered within its respective bore and permits the relaxation of the tolerances defining the concentricity of the bores 108 and 110 as well as the tolerances defining the cylindricity of the intensifier piston 150 as compared with the prior art. The bottom 174 of the lower member defines a second pressure receiving surface which comprises the upper extreme of the metering chamber 122.

The lower member 170 further includes an annular recess 182 fabricated thereon and situated such that the lower edge 184 of the recess 182 will extend within the metering chamber 122 i.e. passed the transition surface 116, as the intensifier piston 150 moves downward therein connecting the metering chamber with the secondary dump orifice 160. The secondary dump orifice 160 is connected via passage 162 to the low pressure port 42 via the fuel passage 70*b*, consequently when the lower edge 184 of the recess 182 extends into the metering chamber 122 the pressure therein will controllably stabilize at the pressure of the second fuel source. It can be seen from the above discussion that the second dump port means comprises a lower annulus i.e. the annular recess 182, the transition surface 116 and the secondary dump orifice 160. When the intensifier piston is at the bottom of its stroke the metering chamber has been reduced to a substantially annular volume and hence the second dump port means initially provides for a variable orifice annulus-to-annulus dumping of fuel within the metering chamber and thereafter a fixed orifice in the manner as shown in FIG. 10. By dumping the fuel in the metering chamber in this manner a rapid yet controllable termination of injection is achieved. More specifically, prior to the time that the nozzle 260 closes the fuel pressure in the metering chamber is controlled to be greater than the pressure due to combustion to minimize blow back of gases. In addition, by controllably lowering the fuel pressure, the nozzle 260 impact velocity is controlled, thus enhancing durability of performance.

Furthermore, by positioning the second dump means between the middle and the metering chambers and by constantly communicating the second dump port means with a lower source of pressure, a controlled leakage path is created. As an example, during the injection mode of operation, the pressure within the upper and the metering chambers dramatically increases and absent the present invention, would permit fuel to leak into the middle chamber, inhibit further piston motion and cause a reduction in the intensification ratio. By utilizing the present invention, the leakage flow is collected within the annulus or recess 182 and diverted away from the middle chamber, thereby eliminating the above problem.

Figure 7:
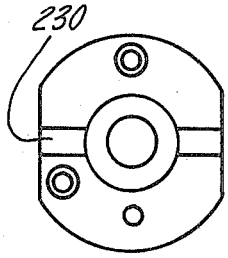
FIG. 7 is a further cross-sectional view of the invention taken through Section 7—7 of FIG. 4.

The injector 20 further includes a spring retainer 200 comprising subsections 202, 204 and 206 which are joined together by pins 208*a* and *b;* however, only pin 208*a* is shown in FIG. 2. The spring retainer 200 comprises a cavity 220 that is adapted to receive a plunger spring 222. The plunger spring 222 is adapted, at one end, to receive a plunger seat 224 which, in turn, is adapted to receive a portion of a plunger 266 through the opening 226. The chamber 220 is connected to the fluid passage 70*b* via the fuel passages 230. These passages 230 are illustrated in FIG. 7. The other end of chamber 220 is fabricated with a passage 232 which permits communication with a second check valve 234 which is connected to permit fluid flow from chamber 220 through fluid passage 236 and into the metering chamber 122. The spring retainer 200 is further fabricated with a fluid carrying passage 240 having situated therein a blow back valve 242. The fluid passage 240 runs the length of the spring retainer and communicates fuel from the metering chamber to the nozzle 260.

The nozzle 260 is situated within the lower extremes of the jacket 50 and is press fit between the shoulder 60 and the spring retainer 200. Alignment between the the retainer 200 and the nozzle 260 is accomplished by the aligning pins 262*a* and *b* (only the aligning pin 262*a* is illustrated in FIG. 3). The nozzle 260 comprises a one or more outflow orifices 264 and a pressure activated plunger 266 which is reciprocally mounted within a fluid channel 270 and which is biased by the action of the spring 222 to close the orifices 264. The fluid carrying channel 270 is maintained in fluid communication with the fluid passage 240.

Figure 8:
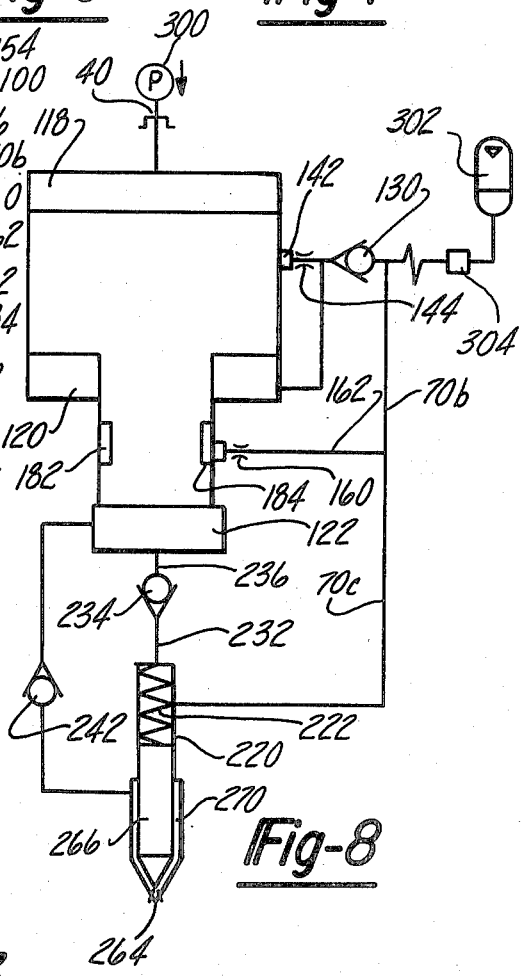
FIG. 8 is a hydraulic schematic diagram illustrating the basic component parts of the present invention.

The operation of the fuel injector 20 is described below in conjunction with FIG. 8. The fuel injector 20 is designed to periodically inject a predetermined quantity of fuel into a combustion cylinder of the diesel engine in correspondence with the combustion process therein and the performance requirements thereof. The fuel injector 20 is of the type which contains a metering chamber 122 and an intensifier piston 150. The reciprocating motion of the piston 150 within the injector 20 is proportional to the differential pressure thereacross. This pressure differential arises due to the pressure of the fuel within the primary or upper chamber 118 which has been received through the first port 40 from a pump (first pressure souce) 300 and to the pressure of the fuel within the metering chamber 122 which has been received through port 42 from the second pressure source such as another pump or accumulator 302 and laminar flow restrictor 304. Prior to each injection event, a specific quantity of fuel must be placed within the metering chamber 122. This is accomplished as follows: At the end of a subsequent injection cycle, the piston 150 is positioned at the bottom of its stroke as illustrated in FIG. 4. The pump 300 thereafter reduces the pressure of the fluid applied to the port 40 to a pressure level below that of the pressure established by the second pressure source 302. This lowering of the pressure applied to the upper chamber 118 thus establishes a pressure differential across the intensifier piston 150 and by virtue of the fact that the pressure in the metering chamber 122 is greater than the pressure in the upper chamber 118, the intensifier piston will begin to rise thus permitting the premetering of fuel to the metering chamber 122. Fuel is received into the metering chamber 122 from the port 42 which is in communication with the fluid passages 70*a, b,* and *c*. The received fuel is communicated via the fuel passages 70 into the spring chamber 220 and through the check valve 234 into the metering chamber. The piston 150 will continue moving upward causing the fuel within the upper chamber 118 to return to the first pressure source 300 until flow therethrough is restricted or the pump pressure increased. It should be appreciated that the amount of fuel permitted to flow into the metering chamber 122 or the amount of piston motion is a variable quantity. When the piston 150 is in its desired uppermost position, with the desired amount of premetered fuel resident in the metering chamber 122, the injection mode of operation is begun in correspondence with the combustion process within a particular cylinder of the engine. The injection mode is initiated by causing the first pressure source to transmit a pressure wave of sufficient magnitude to cause the piston 150 to begin its downward travel. The downward travel of the piston therein compresses the fluid within the metering chamber 122 and within fluid passages 240, and 270. At a pressure level determined by the preload of the spring 222, the pressure force of the fluid in the passage 270 will overcome the bias force of the spring 222 and cause the plunger 266 to lift from its seat, therein permitting the fuel to exit through the orifice(s) 264. The piston 150 will continue its downward motion throughout the injection mode of operation. As the piston proceeds downward toward the bottom of its stroke, the upper edges of the upper cylindrical member 154 will uncover a portion of the annular dump orifice 142. At this point in time, the high pressure fuel which has heretofore been in the upper chamber 118 is dumped through the annular dump port 142, through the fixed orifice 144, through the fluid passage 146, through to the fluid passages within the head 32 and into the second pressure source 302. This action of the piston, with respect to the primary dump orifice 142, relieves the pressure within the upper chamber 118, vents the output of pump 300 and decelerates the downward motion of the piston 150. In addition, the lower edge 184 of the annular recess 182 is positioned in communication with the metering chamber 122. It should be recalled that the annular recess 182 is connected to the secondary dump orifice 160 which, as previously mentioned, is connected to the second fuel source 302. Consequently, the highly pressurized fuel within the metering chamber is dumped through to the second fuel source relieving the pressure therein and terminating the injection mode of operation. At this time, the piston 150 is positioned at the bottom of its stroke and should remain in this position. However, if the fuel injector 20 is fabricated with a biasing spring such as the spring 222, the spring 222 will lightly bias the piston 150 insuring that it remain at the bottom of its stroke thus insuring the accuracy of subsequent quantities of fuel to be premetered into the metering chamber 122. Thus, with the above explanation we have completed the discussion of a single metering and a single injection cycle or event. The explanation of the function of the lower portions of the fluid passages 146 which communicate with the middle chamber 120 follows.

Reference is again made to FIG. 4 which illustrates the piston in its downward most position. As previously mentioned in this position the upper piston member 152 uncovers a portion of the annular dump port 142 therein permitting the high pressure fuel and excess flow within the upper chamber 118 to be dumped. The fluid within the upper chamber 118 is also communicated via the fluid passages 146*a–d* to the middle chamber 120. During a subsequent metering event or cycle, the piston 150 is caused to move upward such that the walls of the upper member close the annular dump port 142. During this time the check valve 130 prevents any fluid from returning to the fluid passages 146*a–d* from the second pressure source consequently, no additional fuel may enter into the middle chamber 120. As the piston 150 moves upward, the volume of the metering chamber 120 increases therein lowering the pressure of the entrapped fuel to its vapor pressure. Consequently, on a subsequent downstroke no unnecessary work is expanded compressing fluid within the middle chamber 120, and the effective intensification ratio of the injector is increased and approaches its theoretical ratio.

Many changes and modifications to the above described embodiment of the invention can of course be carried out without departing from the scope thereof. Accordingly, the scope is intended to be limited only by the scope of the appended claims.

Having thus described the invention, what is claimed is:

1. A fuel injector comprising:

a housing having a first port that is adapted to receive pressurized fuel from a first source, a second port adapted to be connected to a second source of pressurized fuel, a stepped bore and a plurality of fuel passages for communicating fuel;

intensifier piston means reciprocally situated within said stepped bore for defining three variable volume chambers such as an upper or upper chamber, connected to said first port, an inner or middle chamber, a lower or metering chamber, connected to said second port, relative to said housing;

nozzle means extending from said housing and operatively connected, in fluid communication, to said lower chamber, for injecting fuel therefrom in correspondence with the motion of said intensifier piston means, said housing and said intensifier piston means cooperating to provide;

first dump port means selectively connected to said upper chamber for selectively dumping the excess flow from said first source, in correspondence with the motion of said intensifier piston means and for controlling upstream line dynamics;

second dump port means selectively connected to said metering chamber for dumping fuel from said metering chamber, for controllably terminating fuel injection from said nozzle means, for controllably housing the fuel pressure within said metering chamber, for controlling the closing velocity of said nozzle means and for minimizing the blow back of combustion gases from said nozzle means, said second dump port means defining a shaped flow area which initially varies linearly as a function of the stroke of said intensifier piston means and which thereafter attains a fixed flow area;

said housing further including;

first fuel passage means for connecting said second port with said lower chamber including first check valve means for inhibiting flow of fuel from the lower chamber to said second port;

second fuel passage means for connecting said second dump port means to said second dump port;

third fuel passage means for connecting said first dump port means to said second port including second check valve means for inhibiting the flow between said second port and said first dump orifice means; and fourth fuel passage means for connecting said first port means to said middle chamber.

2. The fuel injector as defined in claim 1 wherein:

said first dump port means includes an first annulus means 142 fabricated within the walls of said housing for defining in cooperation with said intensifier means a variable area orifice; and first fixed orifice means connected in series with said annulus means for limiting the flow area of said first annulus means and said orifice means.

3. The fuel injector as defined in claim 2 wherein said second dump port means includes:

second annulus means fabricated on said intensifier piston means for defining in combination with said housing an annular fluid receiving volume, for selectively communicating with said lower chamber in correspondence with the motion of said intensifier piston means, and second fixed orifice means connected in series with said second annulus means, and connected upstream of said second check valve means for limiting the flow area of said second annulus means.

4. The fuel injector as defined in claim 3 wherein said second dump port means dumps the fuel from said metering chamber prior to the time that said first dump port means dumps the fuel from said upper chamber.

5. The fuel injector as defined in claim 4 wherein said second dump port means and said first dump port means operate to simultaneously dump fuel from said lower chamber and said upper chamber, respectively.

6. The fuel injector as defined in claims 4 or 5 further including:

blow back valve means for inhibiting the flow of fluid from said nozzle means to said lower or metering chamber.

7. The fuel injector as defined in claim 6 further including biasing means for biasing said nozzle means towards a closed position.

* * * * *